United States Patent [19]

Shigeta et al.

[11] Patent Number: 4,984,750

[45] Date of Patent: Jan. 15, 1991

[54] METHOD AND APPARATUS FOR REPLACING WEB-LIKE MATERIAL IN A WEB-LIKE MATERIAL SUPPLYING DEVICE

[75] Inventors: Toshio Shigeta, Chiba; Yoshio Kishi, Tokyo; Toshihide Kohata, Tokyo; Makoto Sakano, Tokyo, all of Japan

[73] Assignee: Tokyo Automatic Machinery Works Ltd., Tokyo, Japan

[21] Appl. No.: 373,409

[22] Filed: Jun. 30, 1989

[30] Foreign Application Priority Data

| | | | |
|---|---|---|---|
| Jul. 1, 1988 | [JP] | Japan | 63-165747 |
| Jul. 1, 1988 | [JP] | Japan | 63-165748 |
| Jul. 1, 1988 | [JP] | Japan | 63-88423[U] |
| Jun. 16, 1989 | [JP] | Japan | 1-154050 |

[51] Int. Cl.[5] ..... B65H 19/18; B65H 19/20

[52] U.S. Cl. ..... 242/58.1; 156/504; 156/510; 242/78.8

[58] Field of Search ..... 242/58–58.5, 242/78.8, 57, 195; 226/91, 92; 156/502, 504, 505, 510

[56] References Cited

U.S. PATENT DOCUMENTS

| | | | |
|---|---|---|---|
| 2,957,637 | 10/1960 | Hosken | 242/58.5 X |
| 4,010,911 | 3/1977 | Heitmann | 242/58.4 |
| 4,629,531 | 12/1986 | Kataoka | 242/58.5 |
| 4,848,691 | 12/1987 | Muto et al. | 242/58.1 |
| 4,878,986 | 11/1988 | Nishikawa | 242/58.5 X |
| 4,880,178 | 11/1989 | Goulette | 242/585 X |

*Primary Examiner*—John M. Jillions

*Attorney, Agent, or Firm*—Sandler, Greenblum & Bernstein

[57] ABSTRACT

A method an apparatus for replacing reels of web-like material having a paper-end gripping arm having an attraction surface and a keep pawl. A peeling member peels of a bonded end portion of the material and the material is delivered along a transport path where it is held and the bonded end portion is cut off. The cut end portion is then removed from the transport path. Two reels are supported on reel holding portions and are alternately fed to the transport path. The end portion is bonded to the reel by boring a hole in the end portion, attaching tape to the outer surface in the area of the hole and pressing the tape inwardly so that it extends through the hole and is bonded to the outer surface of the material beneath the hole.

43 Claims, 9 Drawing Sheets

METHOD AND APPARATUS FOR REPLACING WEB-LIKE MATERIAL IN A WEB-LIKE MATERIAL SUPPLYING DEVICE

BACKGROUND OF THE INVENTION

1. Field of the Invention

The present invention relates to an apparatus for exchanging web-like material in a web-like material supplying device for aluminum foil, packaging material, etc. used in a cigarette packaging machine or other machines. More specifically, the apparatus includes a delivery portion having a connection station, reel holding portions provided at upstream ends thereof for supplying material through two transport paths. A reel for web-like material with the material wound thereon is detachably held on each of the holding portions, and the web-like material is alternately supplied from both the reel holding portions to a delivery path through the respective transport paths.

2. Description of Background and Relevant Information

An apparatus for exchange of web-like material in a web-like material supplying device of this kind has been disclosed, for example, in Japanese Patent Application No. 61-312561 (Japanese Patent No. 63-165259), in which an end of web-like material on a reel is held by an attraction surface and a keep pawl. An operating arm is then moved away from the reel, whereby the web-like material is drawn onto the transport path and thereafter the material is delivered by cooperation between a roller of the operating arm and a feed roller provided on the transport path and is fed into the connection station of the delivery path. In this way, drawing a web-like material is automated.

In the apparatus described above, an end of the web-like material peeled from a reel is fed into a transport path and a delivery path. Where a bonded portion of paste is adhered to the wound end portion of the web-like material to hold it to the outer periphery of the reel or where the web-like material is damaged during transportation or handling, the material may become clogged in the transport and/or the delivery path.

In the conventional construction of temporarily holding a web-like material in a web-like material supplying device as described above, it is essential to project the end of the web-like material from the outer peripheral end of the reel by a sufficient length capable of being attracted and held. However, a method of temporarily holding an end of a web-like material involves a problem in that paste is normally poured and applied by manual operation upon termination of the winding of the material. Therefore, unevenness in the temporarily holding force occurs due to a variation in pasting position or pasting area. As a result, inaccurate peeling-off of an end of the material from the reel results. In the case where a web-like material cannot be drawn or the temporarily holding force is stronger than needed, the surface of the material becomes peeled off and damaged during the peeling of the end. Another problem is that the pasting work takes time and increases the cost of materials.

SUMMARY OF THE INVENTION

An object of the invention is to automatically cut an end of the web-like material, remove the cut-piece to outside the transport path and deliver the web-like material with the cut end to the delivery path.

According to the invention, a web-like material supplying apparatus for feeding web-like material wound to form a reel, along a transport path includes a reel holding portion onto which the reel is loaded at an upstream end of the apparatus; a gripping means including a paper-end gripping arm located downstream of the reel holding portion, the paper end gripping arm includes an attraction surface and a movable member such as a keep pawl which moves towards and away from the attraction surface; a cutter located downstream of the paper-end gripping arm movable in and out of the transport path for cutting an end portion of the web-like material; and a means for removing a cut piece located downstream of the cutter for directing a cut piece of the web-like material to a discharge path outside the transport path.

The paper-end gripping arm includes a drawing lever and a guide lever connected in a substantially V-shape. A roller is attached to the end of said guide lever. The paper-end gripping arm is movable so that the attracting surface and the roller are movable toward and away from the reel.

According to another aspect of the invention, a feed roller is located in the transport path. The roller attached to the guide lever cooperates with the feed roller to feed the material when the paper-end gripping arm is moved away from the reel. The roller attached to the guide lever is longer than the width of the material. The attraction surface is located on an end surface of the drawing lever.

According to another aspect of the invention, a connection station in the transport path connects an end of the web-like material to an end of web-like material from another reel. The means for conducting a cut piece selectively communicates the transport path with the connection station or with the discharge path.

An object of the invention is to provide a second reel holding portion onto which a second reel is loaded. Material from both reels are alternately supplied to the transport path.

According to another aspect of the invention, a paper keep mechanism is provided for holding the material to be cut by said cutter. A receiving bed cooperates with the paper keep mechanism to hold the material moving along the transport path.

The cut piece removal mechanism includes an under guide positioned between the paper keep mechanism and the cutter. The under guide is movable in a direction away from said transport path to direct a cut piece of the web-like material outside the transport path. Preferably, the under guide is movable in a direction substantially perpendicular to the transport path. An upper guide is in opposed relation to the under guide and the transport path is located between the upper guide and said under guide. The upper guide includes a plurality of holes for directing compressed air toward said under guide.

The apparatus further includes a peeling member located adjacent the reel holding portion for peeling of an end of the web-like material from the reel. The peeling member includes a resilient plate adapted to tangentially contact the outer periphery of the reel to separate an end of the material from the remainder of the material. A receiving plate is arranged substantially parallel to the resilient plate, whereby material separated from the outer periphery of the reel moves between the resilient plate and the receiving plate.

Detectors are provided for detecting the end of the material and the peeling off of the end portion. The receiving plate includes openings so as not to obstruct detection by the detectors.

According to another aspect of the invention, the end of the web-like material is temporarily bonded to the outer periphery of the reel. The peeling member separates the end from the remainder of the reel.

According to still another aspect of the invention, the attraction surface includes suction holes connected to a vacuum source. At least part of the attraction surface is inclined to facilitate movement of the movable member or keep pawl.

The paper-end gripping arm is movable toward and away from the reel. A press plate is located downstream of said reel holding portion, and cooperates with the attraction surface to hold an end of the material when the paper-end gripping arm is moved away from the reel. The press plate is movable to a retracted position so as not to interfere with the movement of the paper-end gripping arm, to an intermediate position to allow movement of the material, and to an advanced position where the plate is urged against the attraction surface. The press plate includes a linkage means to allow movement toward and away from the attraction surface, which includes a first elongated rod pivotally connected to a back surface of the press plate, and a second elongated rod having one end connected to the back surface of the press plate and the other end engagable with an actuator. The first and second elongated rods are substantially parallel to each other. The actuator can be two cylinders opposedly arranged and substantially perpendicular to the second rod. A spring is located between the back surface of the press plate and the first elongated rod.

The invention also relates to a method of feeding web-like material wound to form a reel along a transport path where the method includes the steps of: holding the reel on a reel holding portion upstream of the transport path; separating an end of the web-like material from the outer periphery of the reel; holding the end in the transport path at a position downstream of the reel holding portion; cutting the material upstream of the end to form an end portion; and removing the cut end portion from the transport path.

The end of the web-like material is temporarily bonded to the outer periphery of the reel and the separating step includes inserting a peeling member between the end and the outer periphery of the reel. The separating step further includes rotating the reel in the delivering direction so that the end of the material moves over the peeling member.

The method further includes gripping the end of the material with a gripping arm after the end is separated from the reel, and then rotating the reel in the direction opposite to the delivery direction to remove the end from the peeling member. The material is attracted by an attraction surface on the gripping arm while the reel is being rotated in the direction opposite to the delivery direction. The end of the material is detected when it has been attracted by the attraction surface and rotation of the reel is stopped. The attraction surface is then moved and the reel is rotated in the delivery direction after the end has been detected.

According to another aspect of the invention, the end of the material is pressed by a press plate, and the material is moved in the delivery direction while being pressed so that deformations in the material are removed. The end of the material is held by suction while the end portion is being cut.

According to another object of the invention, a portion of the transport path is moved to remove the cut end portion. Compressed air is directed to remove the cut end portion. The remainder of material is delivered along the transport path after the cut end portion has been removed.

According to another aspect of the invention, the method includes holding two reels on separate reel holding portions and delivering the material of the second reel after the first reel has been depleted and further connecting the front end of the material on the second reel to the rear end of the material on the first reel.

Another object of the invention is to bond the end of the web-like material to the outer periphery of the reel by boring a hole in an end portion of the material, attaching tape to the outer surface of the end portion in the area of the hole, and pressing the tape inwardly of the hole to contact the material in the layer beneath the end portion.

Another aspect of the invention is a reel of web-like material having an end portion bonded to the outer periphery of the reel having a hole in an end portion of the material, and tape attached to the outer surface of the end portion of the material in the area of the hole and extending through the hole to contact the material in the layer beneath the end portion. The material may be aluminum foil and the tape may be an aluminum deposited polyester self-bonding tape.

Another object of the invention relates to a method of bonding the end of a reel of web-like material to the outer periphery of the reel including the steps of: boring a hole in an end portion of the material; attaching tape to the outer surface of the end portion in the area of the hole; and pressing the tape inwardly so that it extends through the hole and is bonded to the outer surface of the material beneath the hole. The tape is larger than the area of the hole and the hole is formed by a punch.

BRIEF DESCRIPTION OF THE DRAWINGS

The invention will now be described by way of non-limiting embodiments, with reference to the annexed drawings in which.

DETAILED DESCRIPTION OF PREFERRED EMBODIMENTS

Figure 1:
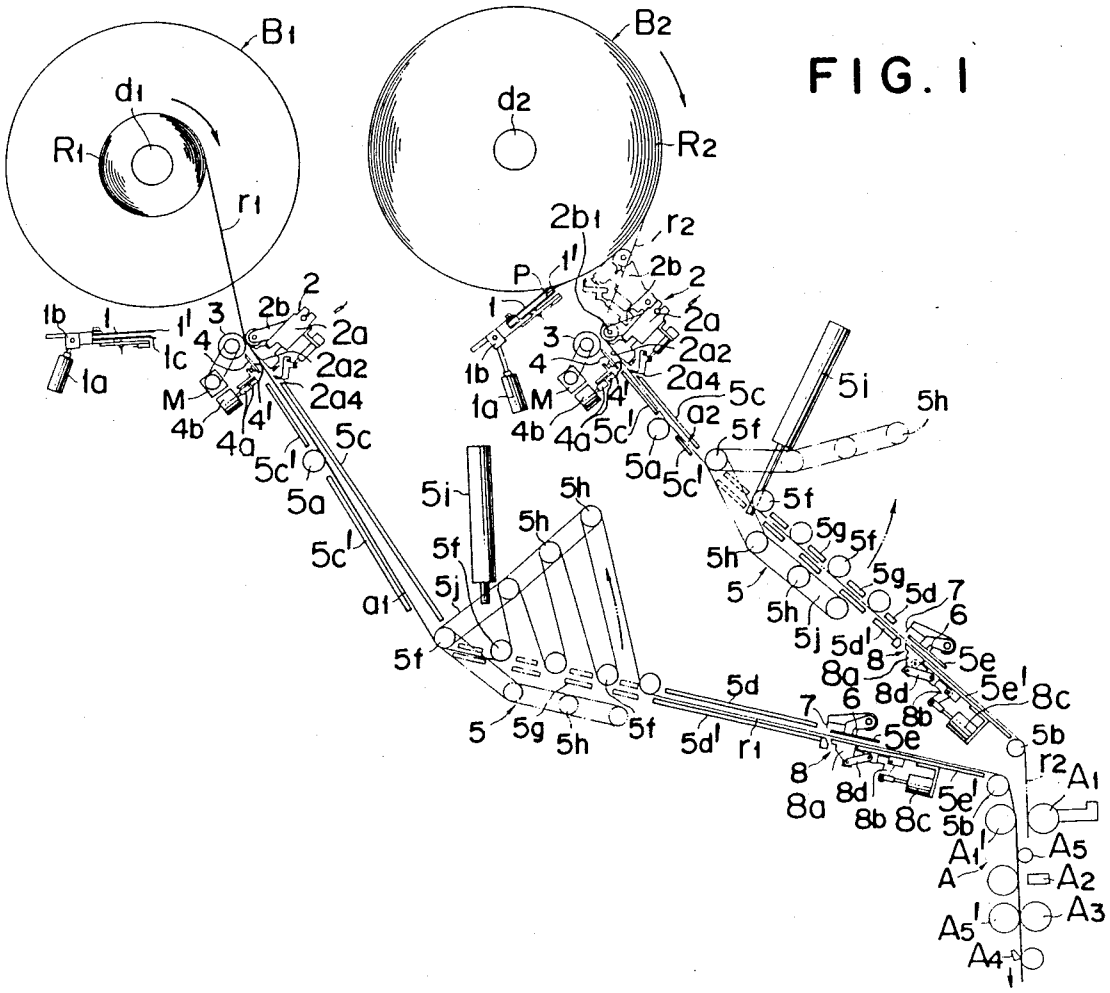
FIG. 1 is a front view of an apparatus for exchanging web-like material in a web-like material supplying device.

According to the invention, a paper-end gripping arm is formed with a drawing lever and a guide lever positioned to form a substantially V-shape which is provided downstream of each of the reel holding portions. An attraction surface having an attraction hole and a keep pawl which moves toward and away from the attraction surface are provided at the end of the drawing lever and a roller is provided at the end of the guide lever. The paper-end gripping arm is movable so that the attraction surface and the roller are moved toward and away from the reel for web-like material. A feed roller cooperates with the roller and is spaced from the reel to deliver the end of the web-like material toward said connection station which is provided on the transport path. A cutter is movable into and out of the transport path and a paper keep mechanism and a cut-piece removal mechanism switchably communicate with the outside of the transport path downstream of the feed roller. Alternately, a paper keep mechanism and a cut-piece removal mechanism may selectively communicate with either a connection station or a discharge path.

According to the present invention, the end of web-like material of a reel for web-like material in the reel holding portion is held by the attraction surface and the keep pawl. The paper-end gripping arm is then moved away from the reel, whereby the web-like material is drawn into the transport path, and thereafter the material is delivered by cooperation between the roller and the feed roller. The web-like material is temporarily stopped by the paper keep mechanism and the end portion of the web-like material is cut. The cut-piece is then fed outside the transport path or into the discharge path by a cut-piece removal mechanism and the web-like material is then fed into the connection station of the delivery path for stand-by before further feeding.

In the embodiment shown in FIG. 1, web-like material is wound onto reels $R_1$, $R_2$. The material may be aluminum foil, for example. Transport paths $a_1$, $a_2$ are located between reel holding portions $B_1$, $B_2$ which include bobbin holders, or the like, on which the reels $R_1$, $R_2$ are detachably mounted, and a delivery path for transporting the material $r_1$, $r_2$ drawn out of the reels $R_1$, $R_2$.

The reel holding portions $B_1$, $B_2$ include reversible rotational shafts $d_1$, $d_2$ and the reels $R_1$, $R_2$ are engageably loaded onto the shafts $d_1$, $d_2$.

One of the reels $R_1$, $R_2$ loaded onto the two reel holding portions $B_1$, $B_2$ is in use while the material is supplied to the delivery path (A), while the other is in stand-by for the exchange (in FIG. 1, $R_1$ is in use while $R_2$ is in stand-by).

The reels $R_1$, $R_2$ of material $r_1$, $r_2$ include a bonding material such as paste at a portion near the wound-end which is located along the outer peripheral end of the material. In the present embodiment, a hole is made in a substantially central portion along the width near the end P and adhesive tape is attached to the outer surface thereof to bond it through the hole, as will be described in more detail below.

Loading of the reels $R_1$, $R_2$ onto the holding portions may be either automatic by way of a manipulator or manual.

The transport paths $a_1$, $a_2$ each include a peeling member 1, a paper-end gripping arm 2, a feed roller 3, a press plate 4 and a guide mechanism 5. These elements have substantially the same structure in each of the paths and therefore, only the elements of the transport path $a_2$ will be described. The same elements in transport path $a_1$ are indicated by the same reference numerals and the explanation thereof is omitted.

The peeling member 1, paper-end gripping arm 2, feed roller 3 and press plate 4 are located directly under reel holding portion $B_2$. The peeling member 1 is formed by a plate of a resilient material, for example, spring steel, and has an end 1' formed to converge towards pasted portion of the material $r_2$ and includes a base end connected to a bracket 1*b* which moves up and down by operation of an air cylinder 1*a*. The end portion 1' in the upper limit position tangentially placed in contact with the outer surface of the bottom of the reel $R_2$ so that the peeling member becomes slightly curved and deformed.

A receiving plate 1*c* which moves up and down together with the peeling member 1 is provided below and parallel to the peeling member 1, and a detector 1*d* for detecting the end P of the material $r_2$ is spaced from the outer peripheral end of the reel R and a detector 1*e* for detecting the peeling of the pasted portion are respectively located under the receiving plate 1*c* in a fixed spaced relation in an axial direction of the peeling member 1.

Holes $1c_1$, and $1c_2$ are provided in the receiving plate 1*c* so as not to obstruct detection by detectors 1*d*, 1*e*.

If an attraction surface $2a_2$ of the paper-end gripping arm 2 is arranged at a position in which it can positively receive the end P of the material $r_2$ peeled off from the outer peripheral end of the reel $R_2$, the receiving plate 1*c* may not always be needed. Also, if the reel $R_2$ is rotated by a predetermined amount until the pasted portion is positively peeled off after detection by the detector 1*d*, detector 1*e* may not always be needed.

The paper-end gripping arm 2 is integrally formed with a drawing lever 2*a* and a guide lever 2*b* positioned with respect to the drawing lever to form a substantially V-shape. The gripping arm 2 is pivotable by operation of an air cylinder 2*c* and is movable up and down by operation of a drive mechanism (not shown).

The drawing lever 2*a* is formed with an attraction surface $2a_2$ having open suction holes $2a_1$, $2a_1$ connected to a source of vacuum. The attraction surface $2a_2$ is located at the end surface of the lever 2*a*. The lever 2*a* is provided with a keep pawl $2a_4$ which moves towards and away from the attraction surface $2a_2$.

While in the present embodiment, a part of the attraction surface $2a_2$ is inclined to facilitate movement of the keep pawl $2a_4$ towards and away from the attraction surface $2a_2$, it is noted that the whole attraction surface $2a_2$ may be formed in one and the same plane.

The end of the guide lever 2*b* is provided with a loosely rotating roller $2b_1$, which is slightly wider than the material $r_2$. When the paper-end gripping arm 2 is at the lower limit position, the roller 2*b* constitutes the upstream end of the transport path $a_2$. 5 The paper-end gripping arm 2 moves to the upper limit position while being rotated and upwardly moved from the solid-line position (lower limit position) in FIGS. 1 and 2. At the upper limit position, the attraction surface $2a_2$ and the roller $2b_1$ come into contact with the outer surface of the bottom of the reel $R_2$ (as indicated by the broken lines in FIGS. 1 and 2).

The paper-end gripping arm 2 is provided with a position detector 2d and a paper-end detector 2e which are rotated and moved up and down together with the arm 2.

A feed roller 3 is opposedly located with respect to the roller $2b_1$ of the paper-end gripping arm 2 at the lower limit position and is driven in both forward and reverse directions by means of a motor m. The feed roller 3 is moved towards and away from the roller $2b_1$ by means of a mechanism such as an air cylinder (not shown).

The press plate 4 is wider than the material $r_2$ and is an elongated web-like plate extending along the transport path $a_2$. When the press surface 4, is at the lower limit position, the press plate 4 is opposed to the attraction surface $2a_2$ of the paper-end gripping arm 2. A parallel linkage 4a is provided at a rear part of the press surface 4'.

Figure 7:
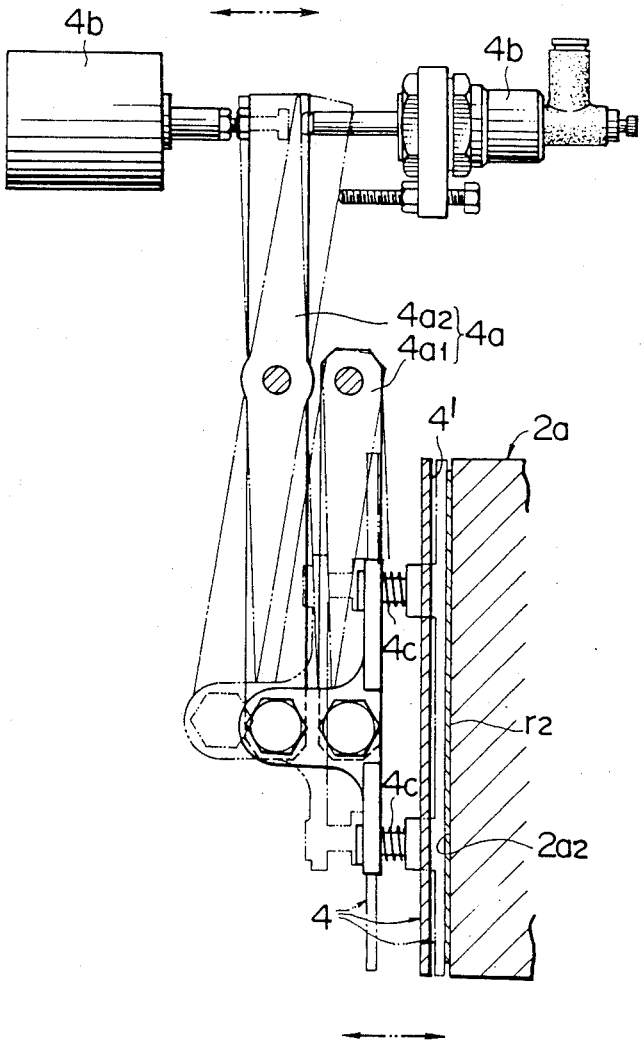
FIG. 7 is an enlarged view taken on line VII—VII of FIG. 4.

The parallel linkage 4a includes an elongated rod $4a_1$ positioned on the side of the press plate 4. The rod $4a_1$ has one end pivotally connected to the back surface of the press plate 4. The other end of a second elongated rod $4a_2$ extends so that two air cylinders 4b, 4b are opposedly disposed in a direction perpendicular to the second rod (see FIG. 7). Both air cylinders 4b, 4b are operated to move the press surface 4' toward and away in three stages, that is, a retracted position where the press surface 4' does not interfere with the movement and rotation of the paper-end gripping arm 2; an intermediate position where the press surface 4' is arranged on an extended line of the inner surface of the guide plate 5c' of a guide mechanism 5 to be described below; and an advanced position where the press surface 4' is urged against the attraction surface $2a_2$. Accordingly, the press surface 4' in its intermediate position serves as a guide when the material $r_2$ is delivered.

A spring 4c is provided at a pivoted portion between the back surface of the press plate 4 and the elongated rod $4a_1$ to enable the angle of the press surface 4' to be adjusted. At the advanced position, the press surface 4' is parallel to the attraction surface $2a_2$.

The drive mechanism for the press plate 4 is not limited to the aforementioned parallel linkage 4a and two air cylinders 4b,4b. For example, if positional control can be positively maintained, a two-stage cylinder which projects in two stages may be applied.

The guide mechanism 5 includes guide rollers 5a,5b guide plates 5c,5c', 5d,5d', and 5e,5e', a group of rollers 5f, a group of guide pieces 5g and a group of tension rollers 5h which form and define the upper and lower sides of the transport path $a_2$.

The group of rollers 5f includes a plurality of rollers freely rotatably and spaced apart on the transport path $a_2$. The group of guide pieces project in and out between the rollers of the group of rollers 5f, as shown in FIG. 1.

The group of tension rollers 5h include a plurality of rollers which are freely rotatable and are spaced apart on a side plate 5j which is moved up and down about one end thereof by means of an air cylinder 5i, each of the rollers being moved up and down in a direction crossing the transport path $a_1$ and passing between the rollers of the group of rollers 5f.

In the transport path $a_2$ on the stand-by or waiting side, as shown in FIG. 1, the group of guide pieces 5g project between the roller of the group of rollers 5f to form a part of the transport path $a_2$, and the group of tension rollers 5h are positioned below the group of guide pieces 5g.

Above the transport path $a_2$, a part of the guide mechanism 5 is provided with a paper keep mechanism 6, a cutter 7 and a cut-piece removal mechanism 8.

The paper keep mechanism 6 is movable in and out of the transport path $a_2$ to cooperate with a receiving bed 6a integrally formed with guide plate 5e' to hold and support the material $r_2$ which moves on the path $a_2$. The cutter 7 is arranged to move in and out of the transport path $a_2$ at the upstream side of the paper keep mechanism 6 to cut the material $r_2$.

The cutting and removing mechanism (8) is constructed so that one end of an L-type lever 8b is pivotally connected to an under guide 8a that is positioned between the receiving bed 6a of the paper keep mechanism 6 and the cutter 7 to form a part of the guide plate 5e'. The other end of the lever 8b is pivotally connected to an air cylinder 8c. A link 8d which is downwardly displaced from a connection point of the under guide 8a, and bent portion of the L-type lever 8b are, respectively, pivotally mounted to the guide plate 5e so that guide surface 8a' of the under guide 8a is movable in a direction perpendicular to the transport path $a_2$ by operation of the air cylinder 8c.

The guide surface 8a' of the under guide 8a is provided with one or more suction holes $8a_1$ connected to a vacuum source that act along the width of the material $r_2$. An upper guide 8e is integrally formed with guide plate 5e in opposed relation with respect to guide surface 8a' with the transport path $a_2$ located therebetween. The upper guide 8e includes a plurality of jet holes $8e_1$ for compressed air directed at the guide surface 8a' along the width of the material $r_2$.

At the downstream side of the guide surface 8a', a sensor 8f for detecting the end P of the material $r_2$ is directed toward the transport path $a_2$.

The delivery path A includes connection rollers $A_1$, $A_1'$ constituting connection stations, a printing mechanism $A_2$ for printing manufacturing numbers or the like, delivery rollers $A_3$,$A_3'$ and a cutter $A_4$ in sequence. A guide roller $A_5$ may also be provided.

The exchanging operation for the material reels will now be described. The reel $R_2$ is manually or automatically loaded onto stand-by reel holding portion $B_2$ and thereafter the peeling member is energized by operation of a switch or the like.

Figure 2:
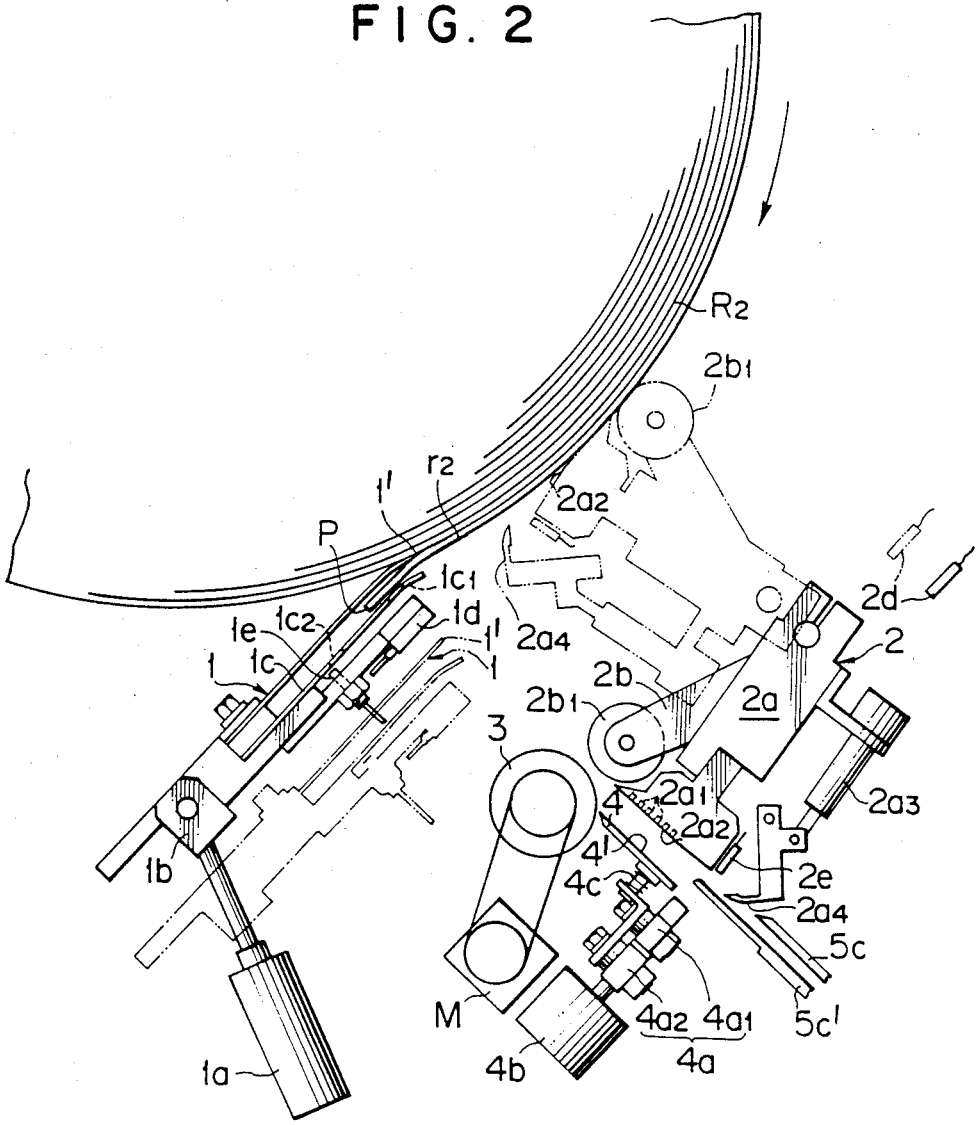
FIGS. 2 to 4 are enlarged front views of the apparatus of FIG. 1 showing steps of the peeling operation of the apparatus.

First, the peeling member 1 and the receiving plate 1c move up, and the end portion 1' of the peeling member 1 tangentially comes into contact with the outer peripheral portion of the reel $R_2$ so that the peeling member becomes slightly curved and stops. Thereafter, the reel $R_2$ slowly rotates in the delivering direction, that is, in the clockwise direction (FIG. 2).

As the reel rotates, the end P of the material $r_2$ on the reel $R_2$ floats along the end portion 1' of the peeling member 1, and as the reel rotates, the end P of the material separated from the outer periphery of the reel $R_2$ moves in and between the peeling member 1 and the receiving plate 1c and is detected by detector 1d. Upon detection, rotation of the reel $R_2$ temporarily stops, and the paper-end gripping arm 2 is rotated in a rightward direction and moves up to reach a given position where at least the roller $2b_1$ comes into contact with the outer peripheral portion of the reel $R_2$. This is detected by the position detector 2d, at which time, the paper-end gripping arm 2 is stopped (as indicated by the broken line in FIG. 2).

Subsequently, the reel $R_2$ is again rotated in a clockwise direction, and the end of the peeling member 1 moves far enough in to peel off the pasted portion. The end P of the material $r_2$ then is detected by detector 1*e*. Then, rotation of the reel $R_2$ is stopped and vacuum to the attraction surface $2a_2$ of the paper-end gripping arm 2 starts the reel $R_2$ is slowly rotated counterclockwise to remove the end P of the material from between the peeling piece 1 and the receiving plate 1*c*.

Thereafter, the reel $R_2$ is still rotated counterclockwise and the end P of the material $r_2$ approaches the attraction surface $2a_2$. Then, the end P is attracted by the vacuum of the attraction surface $2a_2$ and the end P is detected by the paper-end detector 2*e*, at which time, rotation of the reel $R_2$ stops and the peeling member 1 is lowered.

Figure 3:
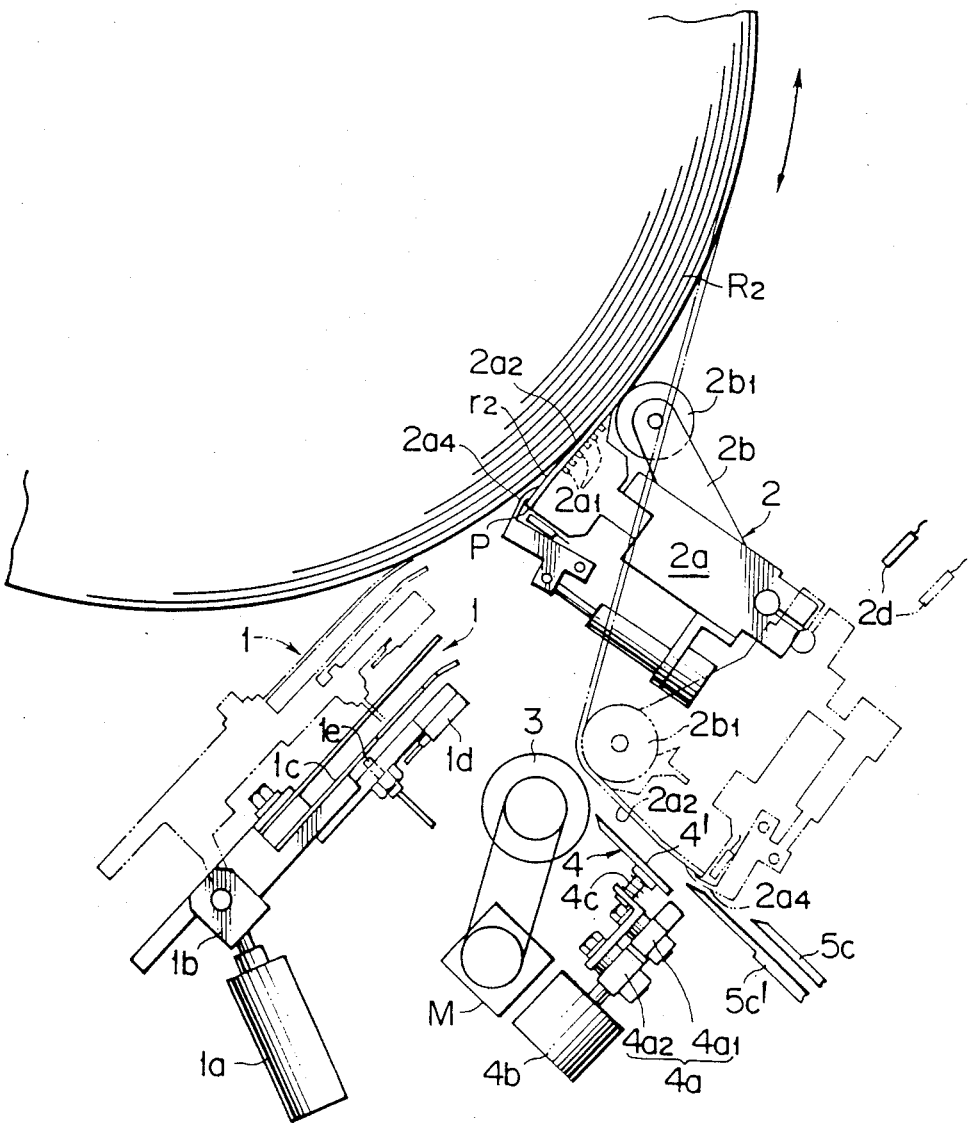

The keep pawl $2a_4$ is closed by the air cylinder $2a_3$, and the end P of the material is held between the pawl $2a_4$ and the attraction surface $2a_2$ (FIG. 3). Thereafter, the paper-end gripping arm 2 moves down and rotates to the left, and simultaneously the reel $R_2$ rotates clockwise to draw the material from the reel. The gripping arm is therefore returned to its original lower limit position (as indicated by the broken line in FIG. 3).

Figure 4:
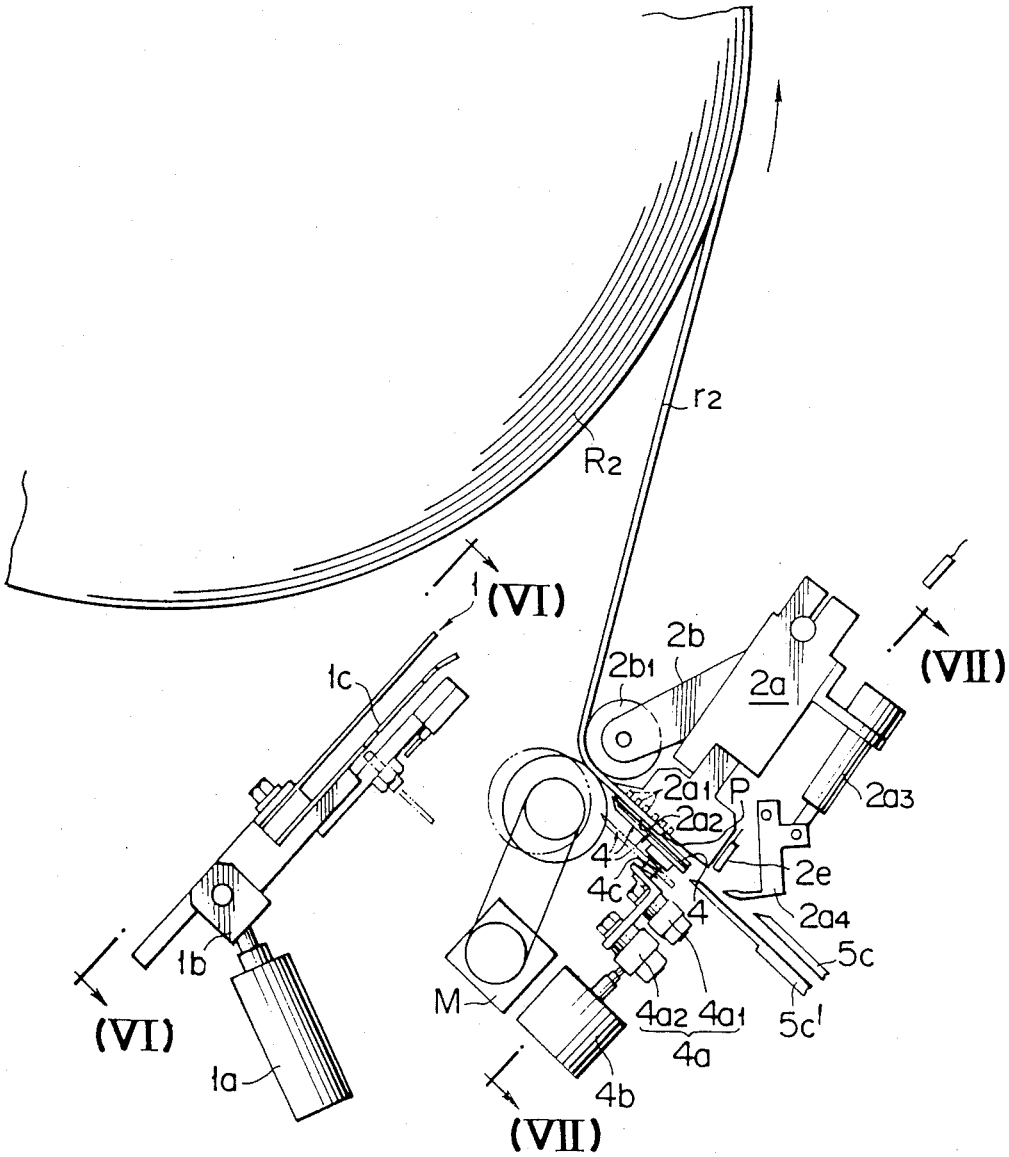

After the paper-end gripping arm 2 has been returned, the keep pawl ($2a_4$) rotates while attracting the end P of the material. The press plate 4 moves from the retracted position to the intermediate position. Thereafter, in the case where a part of the attraction surface $2a_2$ is inclined, the end P of the material is drawn back into the press area by cooperation between the roller $2b_1$ and the feed roller. The feed roller 3 is then separated from the material to terminate the vacuum of the attraction surface $2a_2$ and at the same time the press plate 4 moves to the advanced position to hold the end P of the material between the press surface 4' and the attraction surface $2a_2$ to remove any deformation (FIG. 4).

After a predetermined time, the press plate 4 returns to the intermediate position and the material is delivered by cooperation between the roller $2b_1$ and the feed roller 3, the end P being transported along the transport path $a_2$ to feed it into the guide mechanism 5.

When the end P of the material reaches and is detected by sensor 8*f*, rotation of the feed roller 3 is stopped, and then the paper keep mechanism 6 cooperates with the receiving bed 6*a* to hold the material. Then, the feed roller 3 is slightly reversed to tension the material. The cutter 7 is then actuated to cut an upstream portion of the material from the under guide 8*a*.

Figure 5:
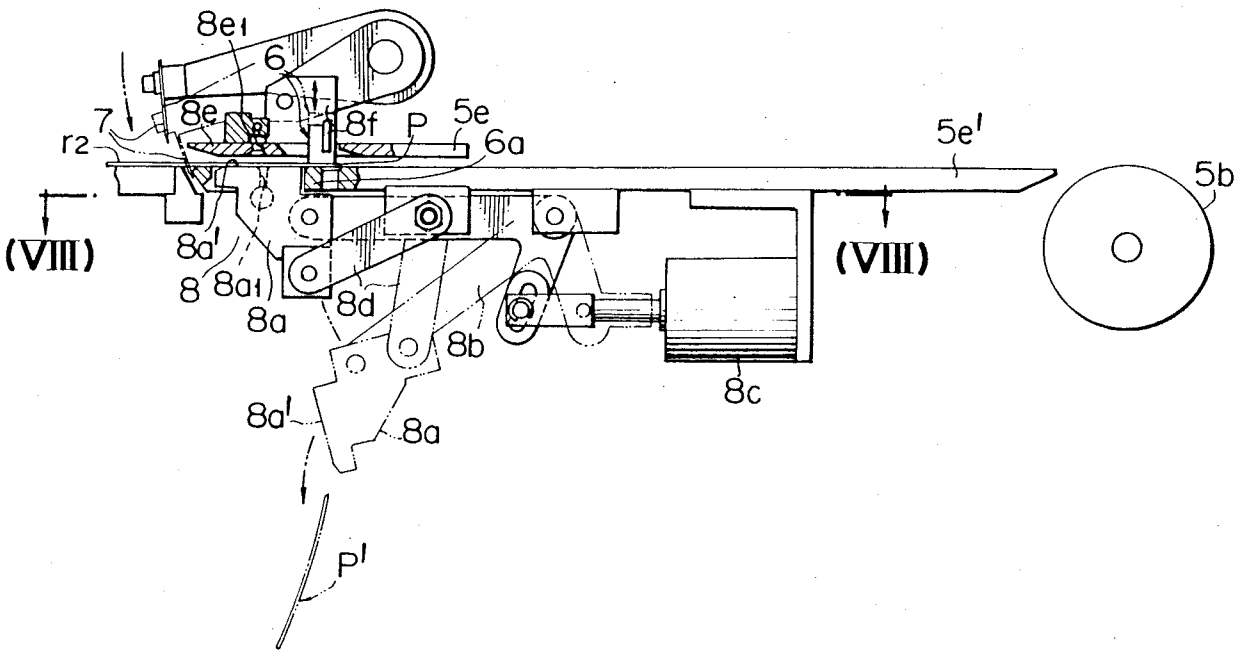
FIG. 5 is an enlarged front view of a portion of the apparatus of FIG. 1 showing the cutting and removing mechanism.
Figure 6:
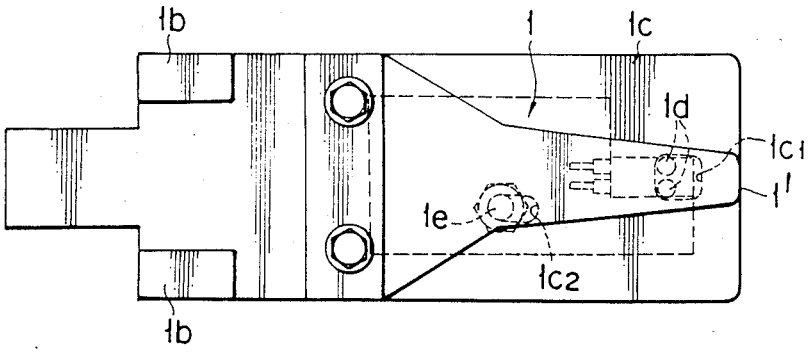
FIG. 6 is an enlarged view taken on line VI—VI of FIG. 4.
Figure 8:
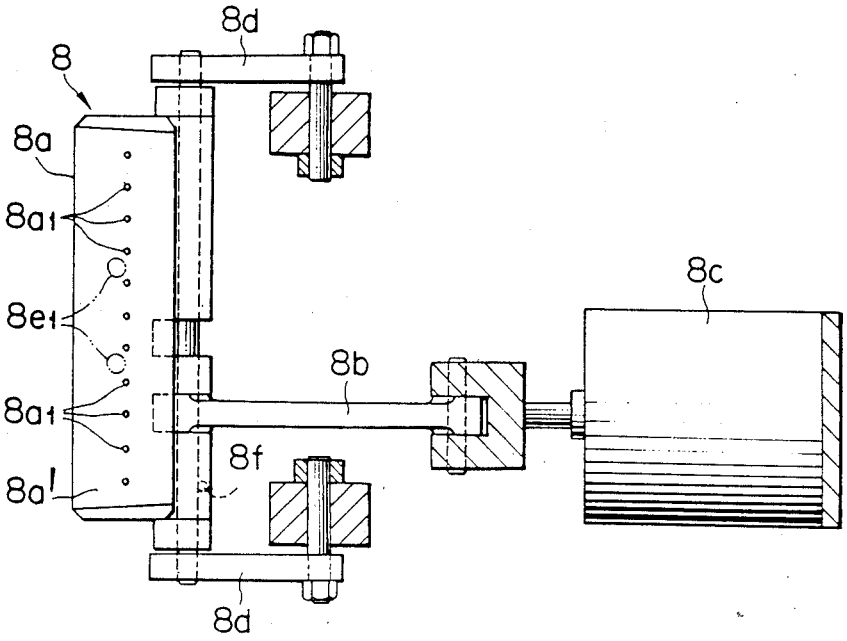
FIG. 8 is an enlarged view taken on line VIII—VIII of FIG. 5.

At this time, the suction hole $8a_1$ of the under guide is already under vacuum so that the cut material P' is held by the guide surface 8*a*'. After the paper keep mechanism is separated from the receiving bed 6*a*, compressed air is directed from the jet hole $8e_1$ of the upper guide 8*e* toward the guide surface 8*a*' with the cut piece P, attracted thereon. The under guide (8*a*) is moved in a direction perpendicular to the transport path $a_2$ by the air cylinder 8*c* to remove the cut piece P' from the transport path $a_2$. Thereafter, vacuum to the under guide 8*a* stops and the cut piece P' is dropped (FIG. 5).

After a predetermined time, the under guide 8*a* returns to its original position, and emission of compressed air from the upper guide 8*c* stops. The material $r_2$ is then delivered by cooperation between the roller $2b_1$ and the feed roller 3 to feed the end thereof into the delivery path A.

When the end of the material reaches a position opposed to the connection rollers $A_1$, $A_1'$ of the delivery path A, the feed roller 3 moves away from the roller $2b_1$ to stop the delivery of the material and the press plate 4 returns to its retracted position. Then, the paper keep mechanism 6 holds the material which is again delivered by cooperation of the receiving bed 6*a*. The group of guide pieces 5*g* of guide mechanism 5 is then moved in from the transport path $a_2$, and the group of tension rollers 5*h* moves up to a predetermined position through the rollers of the group of rollers 5*f* to complete preparation of the connection.

When the remaining amount of the material during use is reduced and the terminal end of the material is detected by a detector (not shown), the cutter 7 is actuated to cut the material. After a specified time after the cutter 7 has been actuated, the paper keep mechanism 6 on the stand-by side is separated from the receiving bed 6*a*, and the connection rollers $A_1$, $A_1'$ contact each other to join the material $r_1$ and the end portion of the material $r_2$ during stand-by, so that the material $r_2$ of the reel $R_2$ is supplied to the delivery path A. The remaining portion of the cut material $r_1$ is re-wound on the reel by reversal of the reel $R_1$.

After the reel $R_2$ has been changed over to be used, the remaining reel $R_1$ is removed from the holding portion $B_1$, and a new reel $R_1$ is loaded. Thereafter, an operation similar to that previously described is carried out to prepare for connection.

Figure 9:
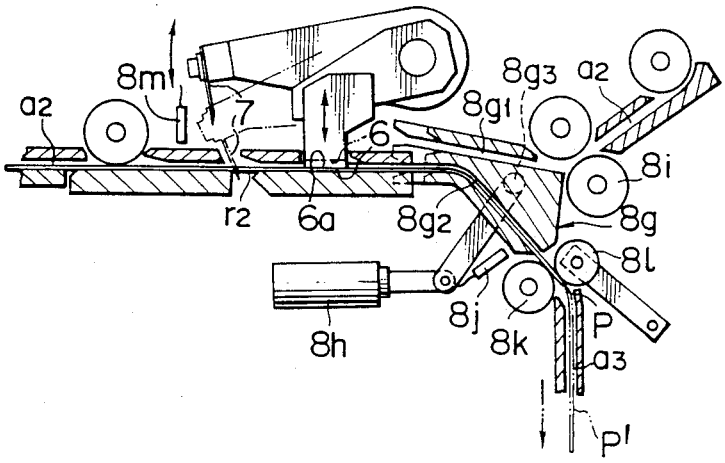
FIG. 9 is an enlarged view of a modified cut-piece removal mechanism showing a removal passage in communication with an upstream side of a transport path.
Figure 10:
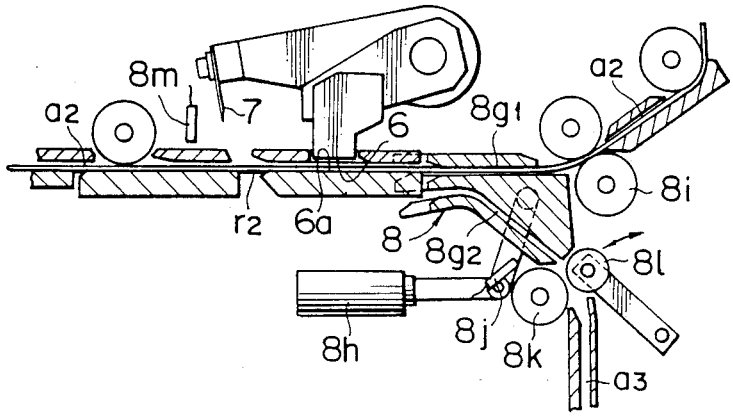
FIG. 10 is an enlarged view of the cut-piece removal mechanism of FIG. 9 showing a normal passage in communication with an upstream side of a transport path.

FIGS. 9 and 10 show another embodiment of the cut-piece removal mechanism 8 where the web-like material is a web-like sheet with print patterns at regular intervals. The discharge path $a_3$ branches from the transport path $a_2$ on the downstream side of the paper keep mechanism 6, and a switching guide 8*g* is disposed at a branch point between both paths $a_2$, $a_3$ so that they may be selectively communicated with each other.

The switching guide 8*g* has a normal passage $8g_1$ for causing the upstream side of the transport path $a_2$ to communicate with the delivery path A and a removal passage $8g_2$ to communicate with the discharge path $a_3$. A central portion of switching guide 8*g* is rotatably supported for movement about axis $8g_3$. An air cylinder 8*h* is provided for moving the switching guide about axis $8g_3$ so that either of passages $8g_1$ or $8g_2$ communicates with the upstream side of transport path $a_2$.

An auxiliary feed roller 8*i* is rotated at a higher speed than that of feed roller 3 and is located at an outlet of the normal passage $8g_1$. A sensor 8*j* for detecting the end of the paper sheet $r_2$ is located at an outlet of the removal mechanism $8g_2$. A removal roller 8*k* and a receiving roller 8*l* which moves towards and away from the removal roller 8*k* are located downstream from feed roller 8*i*.

On the upstream side of the cutter 7 is located a pattern registering detector 8*m* which is spaced by one pitch of a registration mark printed on the sheet $r_2$ from a cutting position of the cutter 7.

The operation of the cut-piece removal mechanism 8 of FIGS. 9 and 10 will now be described. In the initial state, the removal passage $8g_2$ is in communication with the upstream side of the transport path $a_2$, and the end P of the sheet $r_2$ delivered by cooperation between the roller $2b_1$ and the feed roller 3 reaches, and is detected by sensor 8*j*. After a predetermined time, the end P is moved in and between the removal roller 8*k* and the receiving roller 8*l*. When the detector 8*m* then detects a registration mark, rotation of the feed roller 3 stops.

Next, the paper keep mechanism 6 cooperates with the receiving bed 6a to hold the sheet $r_2$, and thereafter, the feed roller 3 slightly reverses to tension the sheet. The cutter 7 is then actuated to cut the sheet $r_2$. Then the paper keep mechanism 6 moves away from the receiving bed 6a and the removal roller 8k rotates to feed the cut piece P' into the discharge path $a_3$ to remove it.

After a predetermined time, when the cut piece P' is removed, the switching guide 8g is rotated by air cylinder 8h to bring the normal passage $8g_1$ into communication with the upstream side of the transport path $a_2$. The sheet $r_2$ is again delivered by cooperation between the roller $2b_1$ and the feed roller 3. The end is fed into the delivery path A by rotation of the auxiliary feed roller 8i. Accordingly, the sheet $r_2$ can be cut at a fixed position and pattern registration can be easily accomplished.

In the above-described preferred embodiments, the receiving plate 1c is arranged below and in parallel with the peeling member 1. The present invention is not limited to this arrangement. If the attraction surface of the sheet end holding arm is arranged at the position where the extremity end of the material peeled off from the outer peripheral end of the reel is positively received, the receiving plate 1c is not necessary. In addition, the detector 1d for detecting the extreme end of the material peeled off from the outer circumference of the reel and the detector 1e for detecting a peeled off pasted or glued portion are arranged below the receiving plate 1c. However, the present invention is not limited to this embodiment and the sensor 1e is not necessary if, after a desired length of material is fed out after detection by the detector 1d until the pasted portion is positively peeled off and then the reel is rotated in the reverse direction.

In the above-described preferred embodiments the part of the attraction surface $2a_2$ is inclined, so that the end of the material is pulled back into the pressing area and then the press plate 4 is pushed against it. The present invention is not limited to this arrangement. If an entire attraction surface $2a_2$ is formed in the same plane, the end of the material is not necessarily pulled back.

Figure 11:
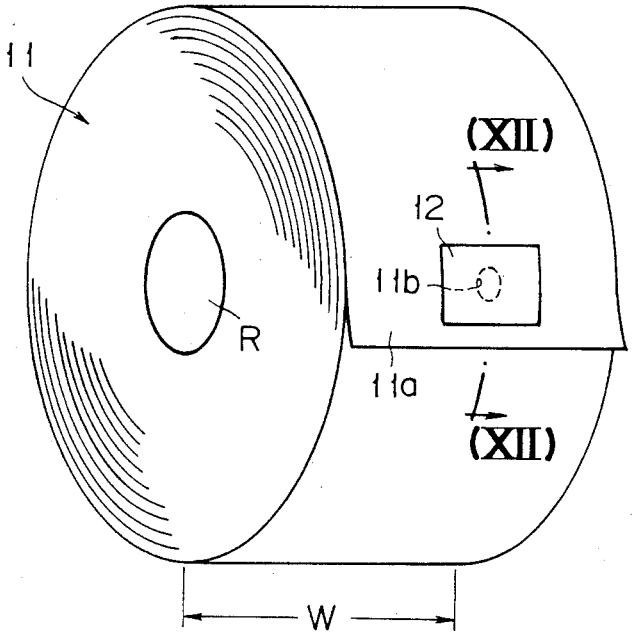
FIG. 11 is a perspective view of a reel of web-like material with an end of the material temporarily bonded to the remainder of the material.
Figure 12:
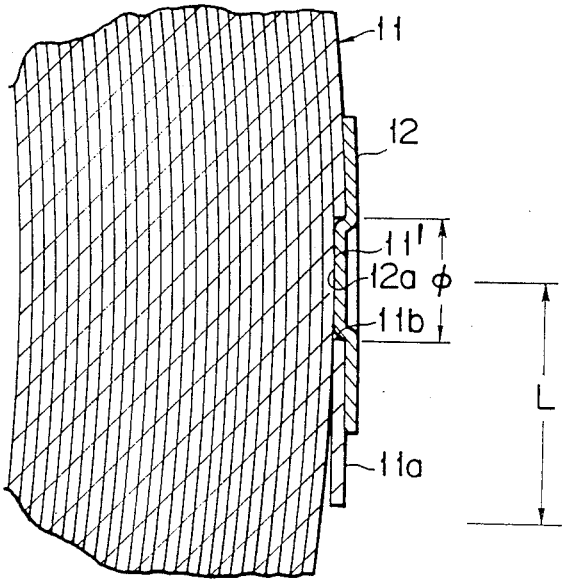
FIG. 12 is an enlarged view taken on line XII—XII of FIG. 11.

FIGS. 11 and 12 show an arrangement for holding the end of web-like material to the outer periphery of the reel. A hole having a predetermined area is bored at a predetermined position at the end of the material. Adhesive tape is attached at the outer surface in the area of the hole and deformed inwardly of the hole so as to extend therethrough. Therefore, the material is temporarily held at a fixed area in fixed position on the outer periphery of the reel of material as further described below.

A web-like material 11 such as aluminum foil is wound onto reels R. The material has its end 11a formed with a hole 11b located at substantially the center of the width of the material 11 and corresponds to the position of the end-gripping arm (not shown in FIGS. 11 and 12) for peeling off the end.

The hole 11b is bored or punched through in the shape of a circle, ellipse or rectangle, etc. at a predetermined position on the end 11a. The hole is formed at a predetermined length from the end edge by means of a punch, for example, simultaneously with or after cutting the end 11a upon termination of winding of the web-like material on the reel. The open area of the hole 11b is determined according to the adhesive force of the adhesive tape 12 attached to the outer surface thereof.

In the case where the punching is carried out after the end 11a of the web-like material has been cut, a fitting corresponding to the end 11a is provided on the punch, and the end edge of the web-like material is merely forced against the fitting to punch the hole 11b at a predetermined position.

The adhesive tape 12 is of a known type which includes a material having a resiliency and is formed on one surface with a self-bonding surface 12a. Preferably, a tape in which it is hard to have the self-bonding paste exposed to the peripheral edge thereof and also having a thin wall-thickness is used. The tape is cut larger than the open area of the hole 11b and is pasted to the outer surface of the web-like material 11 to thereby cover the hole. After the tape has been pasted, it is pressed inwardly of the hole so to be deformed, whereby it is bonded and temporarily held on the outer surface of the material 11' which extends through the hole and is wound on the inner periphery thereof.

The web-like material 11 may be aluminum foil in which paper is bonded to one surface thereof and whose width W is 112 mm, whose thickness is 0.06 to 0.07 mm, and winding weight is 17 kg. In this case, the adhesive tape 12 is an aluminum deposited polyester self-bonding tape. The most favorable sizes obtained by the experiments are a diameter of the hole 11b being 9 mm, a dimension L to the end from the center of the hole being 18 mm, and the size of the adhesive tape 12 being 24 mm×30 mm. The above dimensions depend upon the particular web-like material, the dimensions of the material, etc.

In this way, if the web-like material 11 with the end 11a temporarily held is used, peeling of the end becomes positive and damage to the material occurring during peeling the end can be prevented. Furthermore, the success rate of using automation to draw the web-like material can be improved from approximately 90% to about 100%.

It is noted that the position in which the hole 11b is bored and the number thereof are not limited to those mentioned above but can be varied depending on changes in various conditions, such as the position at which an end gripping arm for peeling off an end is located.

Using the arrangement described above is advantageous because the adhesive tape attached to the upper surface of the hole is deformed inwardly of the hole and extends therethrough. The material is therefore temporarily held at a fixed area in a fixed position on the outer periphery of the web-like material which is attached to the inner periphery of the adhesive surface. Therefore, the temporary holding position and forces of the end of the web-like material can be made uniform in a simple manner.

Accordingly, as compared with the prior art in which the temporary holding of the end of the material is manually pasted, peeling of the end of the material from a reel becomes positive, and damage during peeling of the end can be prevented merely by adjusting the area of the hole according to the adhesive force of the adhesive tape. As a consequence, automation of drawing the material can be positively accomplished and material cost can be reduced.

After the extreme end of the peeling member abuts against the outer circumference of the web-like material reel that is loaded in the reel holding portion, the reel is rotated in a feeding-out direction. The end of the web-like material thereby floats up from the outer circumference of the reel and then the end is held by the attraction surface and the keep pawl. Then the paper-end gripping arm moves away from the reel, thereby pulling the material into the transferring passage. Subsequently, the material is fed out by cooperation between the rollers and the feed roller. The material is fed to the connecting station in the transferring passage and waits there, so that even if the paste position is near the end of the material, the material can be positively peeled off and pulled out. Accordingly, as compared with the prior art in which the end of the web-like material is required to project from the outer circumference surface of the reel by a predetermined length, the paste position does not have to be accurately located, thereby obtaining cost reduction over the prior art.

While in the above-described embodiment, a portion near the wound end of the web-like material is pasted or glued to permit the end to be held along the outer peripheral end of the reel, it is not limited thereto. The wound-end of the web-like material may project from the outer peripheral end of the reel. The end of the web-like material can then be peeled off merely by the attraction surface of the paper-end gripping arm and the keep pawl, and therefore, a peeling member need not be provided.

To summarize the operation of the invention, the end of the web-like material on the reel loaded on a reel holding portion is held by the attraction surface and the keep pawl. The paper-end gripping arm moves away from the reel, thereby pulling the material into the transferring passage and at the same time, the keep pawl moves away from the attraction surface. The press plate is pushed against the attraction surface, and then the end of the belt-like material is held between the press plate and attraction surface to remove any deformities. Thereafter the material is fed out by the cooperation between the roller and the feed roller to a connecting station in the feeding-out passage and waits there. In this manner, the deformation of the end of the web-like material is corrected at the inlet port of the transferring passage and can then be fed out.

Accordingly, any trouble such as a clogging or the like in which a deformed end of the web-like material is fed into the transferring passage and the feeding-out passage by itself is not found in the present device and so a stable feeding-out of the web-like material can be carried out.

Although the invention has been described with reference to particular means, materials and embodiments, it is to be understood that the invention is not limited to the particulars disclosed and extends to all equivalents within the scope of the claims.

We claim:

1. A web-like material supplying apparatus for feeding web-like material adapted to be wound into a reel, along a transport path, the apparatus comprising:

(a) a reel holding portion onto which said reel is loaded at an upstream end of the apparatus;

(b) means for gripping one end of said material, said gripping means being located downstream of said reel holding portion, said gripping means including an attraction surface and a movable member which moves towards and away from said attraction surface;

(c) a cutter located downstream of said gripping means movable in and out of the transport path for cutting an end portion of the web-like material;

(d) means for conducting a cut piece of the web-like material to a discharge path outside of the transport path, said conducting means being located downstream of said cutter; and (e) a peeling member located adjacent said reel holding portion for peeling of an end of the web-like material from the reel, said peeling member including a first plate adapted to contact the outer periphery of the reel to separate an end of the material from the remainder of the material, and a receiving plate arranged substantially parallel to said first plate of said peeling member, whereby material separated from the outer periphery of the reel moves between said first plate and said receiving plate.

2. The web-like material supplying apparatus according to claim 1, wherein said gripping means comprises a drawing lever and a guide lever connected in a substantially V-shape.

3. The web-like material supplying apparatus according to claim 2, and further comprising a roller attached to the end of said guide lever, said gripping means being movable so that said attracting surface and said roller are movable toward and away from said reel.

4. The web-like material supplying apparatus according to claim 3, and further comprising a feed roller in the transport path, said roller attached to said guide lever cooperating with said feed roller to feed the material when the said gripping means is moved away from the reel.

5. The web-like material supplying apparatus according to claim 3, wherein said roller attached to said guide lever is longer than the width of said material.

6. The web-like material supplying apparatus according to claim 2, wherein said attraction surface is located on an end surface of said drawing lever.

7. The web-like material supplying apparatus according to claim 1, and further comprising a connection station in the transport path for connecting an end of the web-like material to an end of web-like material from another reel.

8. The web-like material supplying apparatus according to claim 7, wherein said conducting means selectively communicates said transport path with said connection station or with said discharge path.

9. The web-like material supplying apparatus according to claim 1, and further comprising a second reel holding portion onto which a second reel is loaded, material from both reels being alternately supplied to the transport path.

10. The web-like material supplying apparatus according to claim 1, and further comprising a paper keep mechanism for holding the material to be cut by said cutter.

11. The web-like material supplying apparatus according to claim 10, and further comprising a receiving bed cooperating with said paper keep mechanism to hold the material moving along the transport path.

12. The web-like material supplying apparatus according to claim 10, wherein said cut piece conducting means includes an under guide positioned between said paper keep mechanism and said cutter, said under guide being movable in a direction away from said transport path to direct a cut piece of the web-like material outside the transport path.

13. The web-like material supplying apparatus according to claim 1, wherein said attraction surface includes suction holes connected to a vacuum source.

14. The web-like material supplying apparatus according to claim 1, wherein at least part of said attraction surface is inclined to facilitate movement of said movable member.

15. The web-like material supplying apparatus according to claim 1, wherein said gripping means is movable toward and away from said reel.

16. The web-like material supplying apparatus according to claim 15, and further including a press plate located downstream of said reel holding portion, said press plate cooperating with said attraction surface to hold an end of said material when said gripping means is moved away from said reel.

17. The web-like material supplying apparatus according to claim 1, wherein said first plate is a resilient plate.

18. A web-like material supplying apparatus for feeding web-like material adapted to the wound into a reel, along a transport path, the apparatus comprising:

(a) a reel holding portion onto which said reel is loaded at an upstream end of the apparatus;

(b) means for gripping one end of said material, said gripping mans being located downstream of said reel holding portion, said gripping means including an attraction surface and a movable member which moves towards and away from said attraction surface;

(c) a cutter located downstream of said gripping means movable in and out of the transport path for cutting an end portion of the web-like material;

(d) means for conducting a cut piece of the web-like material to a discharge path outside of the transport path, said conducting means being located downstream of said cutter;

(e) a paper keep mechanism for holding the material to be cut by said cutter; and (f) wherein said cut piece conducting means includes an under guide positioned between said paper keep mechanism and said cutter, said under guide being movable in a direction away from said transport path to direct a cut piece of the web-like material outside the transport path.

19. The web-like material supplying apparatus according to claim 18, wherein said under guide is movable in a direction substantially perpendicular to the transport path.

20. The web-like material supplying apparatus according to claim 18, and further including an upper guide in opposed relation to said under guide, the transport path being located between said upper guide and said under guide.

21. The web-like material supplying apparatus according to claim 20, wherein said upper guide includes a plurality of holes for directing compressed air toward said under guide.

22. A web-like material supplying apparatus for feeding web-like material adapted to be wound into a reel, along a transport path, the apparatus comprising:

(a) a reel holding portion onto which said reel is loaded at an upstream end of the apparatus;

(b) means for gripping one end of said material, said gripping means being located downstream of said reel holding portion, said gripping means including an attraction surface and a movable member which moves towards and away from said attraction surface;

(c) a cutter located downstream of said gripping means movable in and out of the transport path for cutting an end portion of the web-like material;

(d) means for conducting a cut piece of the web-like material to a discharge path outside of the transport path, said conducting means being located downstream of said cutter; and (e) a peeling member located adjacent said reel holding portion for peeling of an end of the web-like material from the reel, said peeling member including a resilient plate adapted to tangentially contact the outer periphery of the reel to separate an end of the material from the remainder of the material.

23. The web-like material supplying apparatus according to claim 22, and further including a receiving plate arranged substantially parallel to said resilient plate, whereby material separated from the outer periphery of the reel moves between said resilient plate and said receiving plate.

24. A web-like material supplying apparatus for feeding web-like material adapted to be wound into a reel, along a transport path, the apparatus comprising:

(a) a reel holding portion onto which said reel is loaded at an upstream end of the apparatus;

(b) means for gripping one end of said material, said gripping means being located downstream of said reel holding portion, said gripping means including an attraction surface and a movable member which moves towards and away from said attraction surface;

(c) a cutter located downstream of said gripping means movable in and out of the transport path for cutting an end portion of the web-like material;

(d) means for conducting a cut piece of the web-like material to a discharge path outside of the transport path, said conducting means being located downstream of said cutter;

(e) a peeling member located adjacent said reel holding portion for peeling of an end of the web-like material from the reel;

(f) a detector for detecting the end of the material; and (g) a receiving plate arranged substantially parallel to said peeling member, said detector being located under said receiving plate.

25. The web-like material supplying apparatus according to claim 24, wherein said receiving plate includes an opening so as not to obstruct detection by said detector.

26. A web-like material supplying apparatus for feeding web-like material adapted to be wound into a reel, along a transport path, the apparatus comprising:

(a) a reel holding portion onto which said reel is loaded at an upstream end of the apparatus;

(b) means for gripping one end of said material, said gripping means being located downstream of said reel holding portion, said gripping means including an attraction surface and a movable member which moves towards and away from said attraction surface;

(c) a cutter located downstream of said gripping means movable in and out of the transport path for cutting an end portion of the web-like material;

(d) means for conducting a cut piece of the web-like material to a discharge path outside of the transport path, said conducting means being located downstream of said cutter;

(e) a peeling member located adjacent said reel holding portion for peeling of an end of the web-like material from the reel;

(f) a detector for detecting the peeling off of the end portion of the material; and (g) a receiving plate arranged substantially parallel to said peeling member, said detector being located under said receiving plate.

27. The web-like material supplying apparatus according to claim 26, wherein said receiving plate includes an opening so as not to obstruct detection by said detector.

28. A web-like material supplying apparatus for feeding web-like material adapted to be wound into a reel, along a transport path, the apparatus comprising:

(a) a reel holding portion onto which said reel is loaded at an upstream end of the apparatus;

(b) means for gripping one end of said material, said gripping means being located downstream of said reel holding portion, said gripping means including an attraction surface and a movable member which moves towards and away from said attraction surface, at least part of said attraction surface being inclined to facilitate movement of said movable member;

(c) a cutter located downstream of said gripping means movable in and out of the transport path for cutting an end portion of the web-like material; and (d) means for conducting a cut piece of the web-like material to a discharge path outside of the transport path, said conducting means being located downstream of said cutter.

29. The web-like material supplying apparatus according to claim 28, and further including a peeling member located adjacent said reel holding portion for peeling of an end of the web-like material from the reel.

30. The web-like material supplying apparatus according to claim 29, wherein said peeling member includes a resilient plate adapted to tangentially contact the outer periphery of the reel to separate an end of the material from the remainder of the material.

31. The web-like material supplying apparatus according to claim 29, and further including a detector for detecting the end of the material.

32. The web-like material supplying apparatus according to claim 31, and further including a receiving plate arranged substantially parallel to said peeling member, said detector being located under said receiving plate.

33. The web-like material supplying apparatus according to claim 29, and further including a detector for detecting the peeling off of the end portion of the material.

34. The web-like material supplying apparatus according to claim 33, and further including a receiving plate arranged substantially parallel to said peeling member, said detector being located under said receiving plate.

35. The web-like material supplying apparatus according to claim 29, wherein the end of the web-like material is temporarily bonded to the outer periphery of the reel, said peeling member separates said end from the remainder of the reel.

36. A web-like material supplying apparatus for feeding web-like material adapted to be wound into a reel, along a transport path, the apparatus comprising:

(a) a reel holding portion onto which said reel is loaded at an upstream end of the apparatus;

(b) means for gripping one end of said material, said gripping means being located downstream of said reel holding portion, said gripping means including an attraction surface and a movable member which moves towards and away from said attraction surface, said gripping means being movable toward and away from said reel;

(c) a cutter located downstream of said gripping means movable in and out of the transport path for cutting an end portion of the web-like material;

(d) means for conducting a cut piece of the web-like material to a discharge path outside of the transport path, said conducting means being located downstream of said cutter; and (e) a press plate located downstream of said reel holding portion, said press plate cooperating with said attraction surface to hold an end of said material when said gripping means is moved away from said reel.

37. The web-like material supplying apparatus according to claim 36, wherein said press plate is movable toward and away from said attraction surface.

38. The web-like material supplying apparatus according to claim 37, wherein said press plate is movable to a retracted position so as not to interfere with the movement of said gripping means, to an intermediate position to allow movement of the material, and to an advanced position where the plate is urged against said attraction surface.

39. The web-like material supplying apparatus according to claim 37, wherein said press plate includes a linkage means to allow movement toward and away from said attraction surface.

40. The web-like material supplying apparatus according to claim 39, wherein said linkage means includes a first elongated rod pivotally connected to a back surface of said press plate, and a second elongated rod having one end connected to the back surface of the press plate and the other end engagable with an actuator.

41. The web-like material supplying apparatus according to claim 40, wherein said first and second elongated rods are substantially parallel to each other.

42. The web-like material supplying apparatus according to claim 40, wherein said actuator comprises two cylinders opposedly arranged and substantially perpendicular to said second rod.

43. The web-like material supplying apparatus according to claim 40, and further comprising a spring located between the back surface of the press plate and said first elongated rod.

* * * * *

UNITED STATES PATENT AND TRADEMARK OFFICE

CERTIFICATE OF CORRECTION

PATENT NO. : 4,984,750

DATED : January 15, 1991

INVENTOR(S) : T. SHIGETA et al.

It is certified that error appears in the above-identified patent and that said Letters Patent is hereby corrected as shown below:

On the Cover Sheet, Abstract [57], line 2, change "an" to ---and---.

At column 6, line 64, delete "5".

At column 7, line 11, change "m" to ---M---.

At column 7, line 17, change "4" to ---4'---.

At column 9, line 9, after "starts" insert ---, and---.

At column 9, line 57, change "P," to ---P'---.

At column 11, line 37, after "embodiments" insert ---,---.

At column 15, line 24 of claim 18, line 7, change "mans" to ---means---.

Signed and Sealed this

Twenty-second Day of June, 1993

*Attest:*

Michael K. Kirk

MICHAEL K. KIRK

*Attesting Officer*

*Acting Commissioner of Patents and Trademarks*

UNITED STATES PATENT AND TRADEMARK OFFICE

CERTIFICATE OF CORRECTION

PATENT NO. : 4,984,750

DATED : January 15, 1991

INVENTOR(S) : T. Shigeta, et. al.

It is certified that error appears in the above-indentified patent and that said Letters Patent is hereby corrected as shown below:

Title page, item [73], Assignee: insert and Japan Tobacco Inc., both of -- after "Ltd.,"

Signed and Sealed this

First Day of November, 1994

*Attest:*

*Attesting Officer*

BRUCE LEHMAN

*Commissioner of Patents and Trademarks*